US010549541B2

(12) United States Patent
Nagatsuka

(10) Patent No.: US 10,549,541 B2
(45) Date of Patent: Feb. 4, 2020

(54) SUPPLY CHANNEL MEMBER AND LIQUID DISCHARGE APPARATUS

(71) Applicant: Yuki Nagatsuka, Kanagawa (JP)

(72) Inventor: Yuki Nagatsuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/929,054

(22) Filed: Oct. 18, 2018

(65) Prior Publication Data

US 2019/0217623 A1 Jul. 18, 2019

(30) Foreign Application Priority Data

Jan. 18, 2018 (JP) ..... 2018-006514
Aug. 24, 2018 (JP) ..... 2018-157399

(51) Int. Cl.

| | |
|---|---|
| ***B41J 2/14*** | (2006.01) |
| ***B41J 2/165*** | (2006.01) |
| ***B41J 2/175*** | (2006.01) |
| ***B41J 2/185*** | (2006.01) |

(52) U.S. Cl.

CPC ..... *B41J 2/17523* (2013.01); *B41J 2/1433* (2013.01); *B41J 2/165* (2013.01); *B41J 2/185* (2013.01); *B41J 2002/14467* (2013.01)

(58) Field of Classification Search

CPC . B41J 2/1433; B41J 2/165; B41J 2/175; B41J 2/17523; B41J 2/185

See application file for complete search history.

(56) References Cited

U.S. PATENT DOCUMENTS

| | | | | |
|---|---|---|---|---|
| 5,485,187 A * | 1/1996 | Okamura | B41J 2/175 347/85 |
| 6,217,164 B1 * | 4/2001 | Hino | B41J 2/17513 347/85 |
| 7,261,399 B2 * | 8/2007 | Miki | B41J 2/17509 347/23 |
| 2014/0071197 A1 | 3/2014 | Chiwata et al. | |
| 2014/0098146 A1 | 4/2014 | Kamiyama | |

FOREIGN PATENT DOCUMENTS

| | | |
|---|---|---|
| EP | 2 292 432 A1 | 3/2011 |
| EP | 2 572 885 A1 | 3/2013 |
| JP | 2003-118135 | 4/2003 |
| JP | 2003-127436 | 5/2003 |
| JP | 2016-159514 A | 9/2016 |

OTHER PUBLICATIONS

Extended European Search Report dated Apr. 16, 2019 in European Patent Application No. 18199790.9, 10 pages.

* cited by examiner

*Primary Examiner* — Anh T Vo

(74) *Attorney, Agent, or Firm* — Oblon, McClelland, Maier & Neustadt, L.L.P.

(57) ABSTRACT

A supply channel member includes a plate, a plurality of main channels formed inside the plate, the plurality of main channels disposed parallel to each other along a surface of the plate in an arrangement direction of the plurality of main channels, a plurality of branch channels branched from the plurality of main channels, respectively, and a connection tube to connect one of the plurality of branch channels to another of the plurality of branch channels.

11 Claims, 10 Drawing Sheets

SUPPLY CHANNEL MEMBER AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-006514, filed on Jan. 18, 2018, and Japanese Patent Application No. 2018-157399, filed on Aug. 24, 2018, in the Japan Patent Office, the entire disclosure of each of which is hereby incorporated by reference herein.

BACKGROUND

Technical Field

Aspect of the present embodiment relates to a supply channel member and a liquid discharge apparatus incorporating the supply channel member.

Related Art

Various types of apparatuses are known that discharge a liquid such as a printer. Hereinafter, the apparatus that discharges the liquid is also referred to as a liquid discharge apparatus. The liquid discharge apparatus discharges various types of color of the liquid. The liquid discharge apparatus includes a plurality of liquid discharge heads for discharging a liquid, for example.

An ink supply piping system is known in which two-branch joints are used to connect one main tank and a plurality of liquid discharge heads while the connection is repeatedly branched from the one main tank to the plurality of ink discharge heads by the two-branch joints.

SUMMARY

In an aspect of this disclosure, a novel supply channel member includes a plate, a plurality of main channels formed inside the plate, the plurality of main channels disposed parallel to each other along a surface of the plate in an arrangement direction of the plurality of main channels, a plurality of branch channels branched from the plurality of main channels, respectively, and a connection tube to connect one of the plurality of branch channels to another of the plurality of branch channels.

In another aspect of this disclosure, a novel liquid discharge apparatus includes a plurality of main tanks to store a liquid, a plurality of liquid discharge heads to discharge the liquid from the nozzles, and a plurality of supply channel members disposed between the plurality of main tanks and the plurality of liquid discharge heads to connect the plurality of main tanks and the plurality of liquid discharge heads. The plurality of supply channel members includes a plate, a plurality of main channels formed inside the plate, the plurality of main channels disposed parallel to each other along a surface of the plate in an arrangement direction of the plurality of main channels, a plurality of branch channels branched from the plurality of main channels, respectively, and a connection tube to connect one of the plurality of branch channels to another of the plurality of branch channels.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
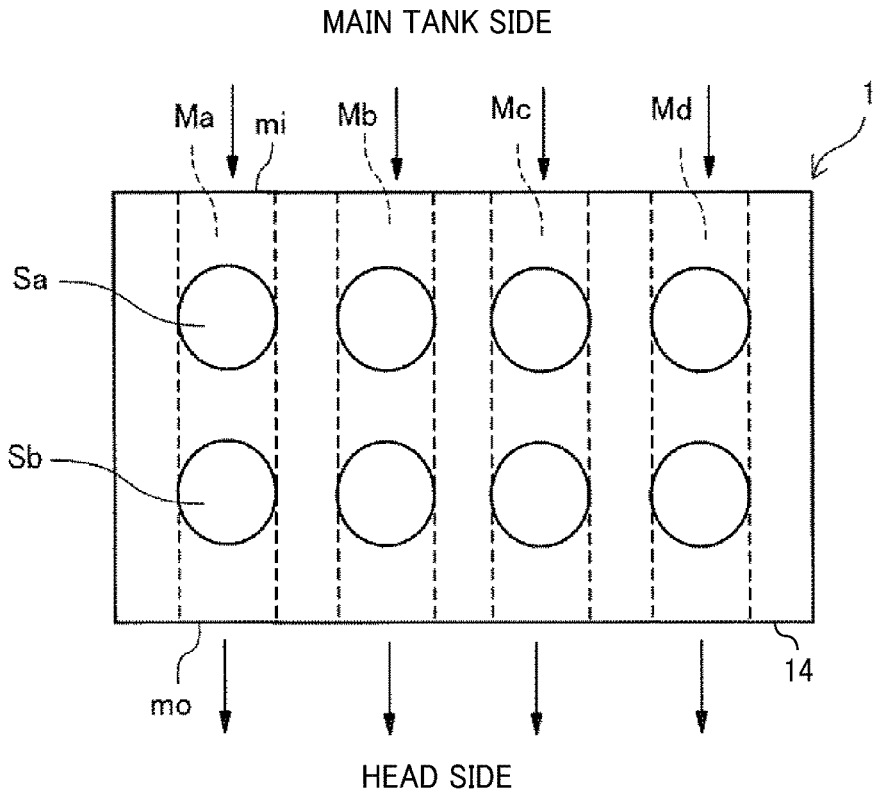
FIG. 1 is a plan view of a supply channel member according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, exemplary embodiments of the present disclosure are described below.

Figure 2:
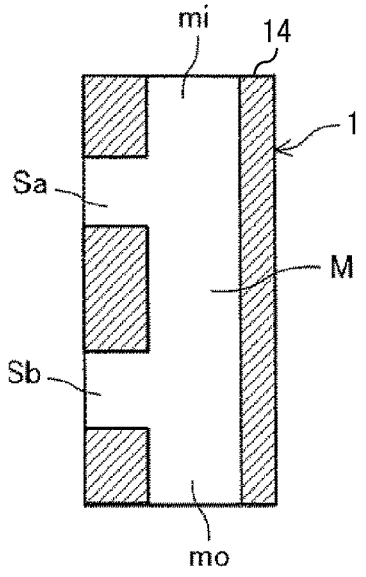
FIG. 2 is a cross-sectional view of the supply channel member in the first embodiment.

A first embodiment of the present disclosure is described with reference to FIGS. 1 and 2. FIG. 1 is a plan view of a supply channel member according to the first embodiment. FIG. 2 is a cross-sectional view of the supply channel member in the first embodiment.

The supply channel member 1 includes a plate 14 and four main channels Ma to Md as supply channels formed inside the plate 14. Each of the main channels Ma to Md includes two branch channels Sa and Sb branched from the corresponding one of the main channels Ma to Md. The number of the main channels Ma to Md (four in FIG. 1) and the number of the branch channels Sa and Sb (eight in FIG. 1) are not limited to the numbers described above. For example, the number of the main channels M may be two or more (more preferably three or more), and the number of the branch channels S may be at least one.

Each of the main channels Ma to Md includes an inlet mi and an outlet mo connected to the outside of the main channels Ma to Md. The inlets mi of the main channels Ma to Md are connected to the main tanks C1 to C8 (see FIG. 4). The main tanks C1 to C8 are liquid storage means that store the liquid to be supplied to the liquid discharge heads 21A to 21C (see FIG. 4). The outlets mo of the main channels Ma to Md are connected to the liquid discharge heads 21A to 21C that discharge the liquid.

Further, the branch channels Sa and Sb may be connected to the branch channels Sa and Sb of the other supply channel member 1. Further, the branch channels Sa and Sb may be connected to the other branch channels Sa and Sb of the same supply channel member 1 (also referred to as "other branch channels").

The branch channels Sa and Sb are disposed in a direction across a direction of liquid flow in the main channels Ma to Md in FIG. 1. Specifically, in FIG. 1, the branch channels Sa and Sb are disposed perpendicular to the directions of liquid flow in the main channels Ma to Md. The directions of the liquid flow in the main channels Ma to Md are vertical direction in FIG. 1. Thus, the branch channels Sa and Sb disposed on one surface side of one supply channel member 1 can be connected to the branch channels Sa and Sb of the same surface side, on which the branch channels Sa and Sb are formed, of the other supply channel member 1. Thus, at least two of the plurality of branch channels Sa and Sb are disposed at same surface of the plate 14. As illustrated in FIG. 2, the supply channel member 1 includes one surface on which the branch channels Sa and Sb are formed (left side in FIG. 2) and the other surface on which the branch channels Sa and Sb are not formed (right side in FIG. 2). Thus, the supply channel member 1 according to the present embodiment can easily connect (couple) a plurality of branch channels S with each other.

Each of the main channels Ma to Md includes two or more branch channels S. Thus, the supply channel member 1 can increase the number of branches of the branch channels S.

Figure 3:
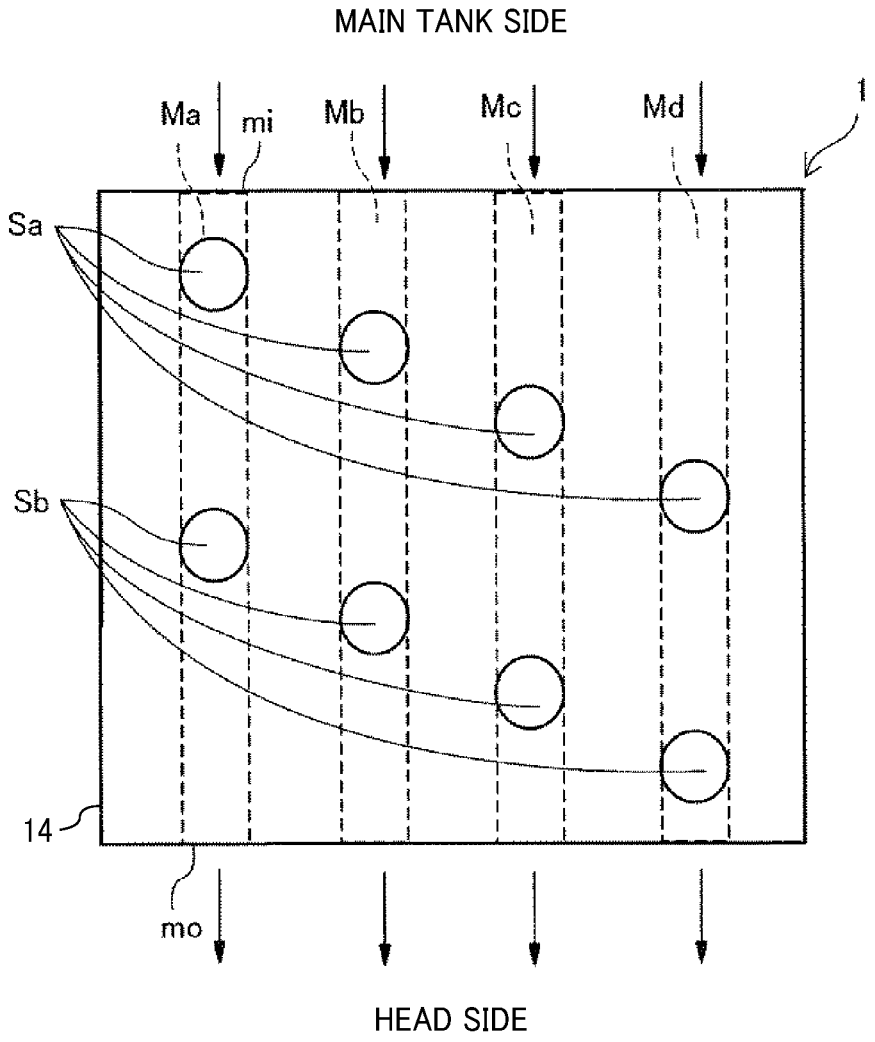
FIG. 3 is a plan view of a supply channel member according to a second embodiment.

Next, a second embodiment of the present disclosure is described with reference to FIG. 3. FIG. 3 is a plan view of a supply channel member according to the second embodiment.

In the present embodiment, positions of the branch channels Sa and Sb are different (shifted) between adjacent ones of the main channels Ma to Md in the liquid flow direction. For example, the positions of the branch channels Sa and Sb are gradually lowered from the main channel Ma on the left end side to the main channel Md on the right end side in an arrangement direction of the main channels Ma to Md (in a direction perpendicular to the direction in which each of the plurality of main channels Ma to Md extends). Thus, the positions at which the plurality of branch channels Sa and Sb is branched are gradually decreased from one end of the plurality of main channels Ma to Md to the other end of the plurality of main channels Ma to Md in the plate 14.

Thus, the supply channel member 1 of the present embodiment can reduce number of intersections and overlaps of connections when the branch channels Sa and Sb of the different supply channel members 1 are connected to each other by the connections such as connecting tubes.

Figure 4:
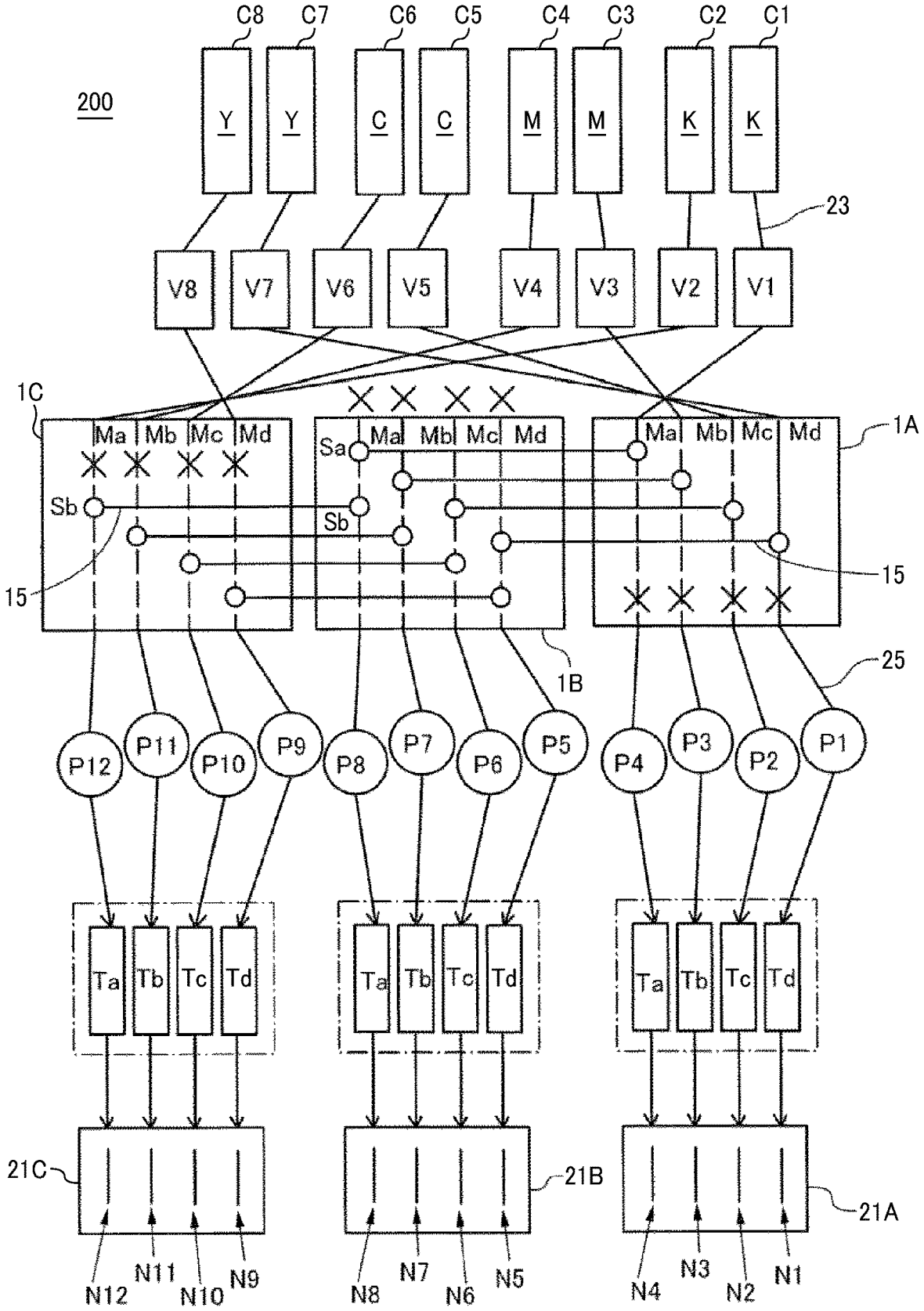
FIG. 4 is a block diagram of a liquid supply system of a liquid discharge apparatus according to a third embodiment.
Figure 5:
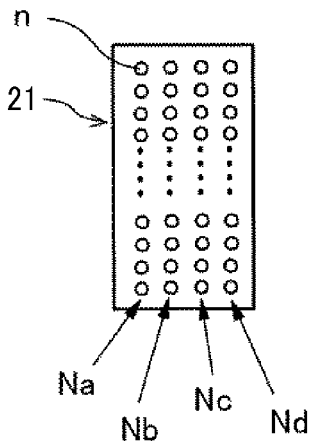
FIG. 5 is a plan view of an example of a liquid discharge head of the liquid discharge apparatus.
Figure 6:
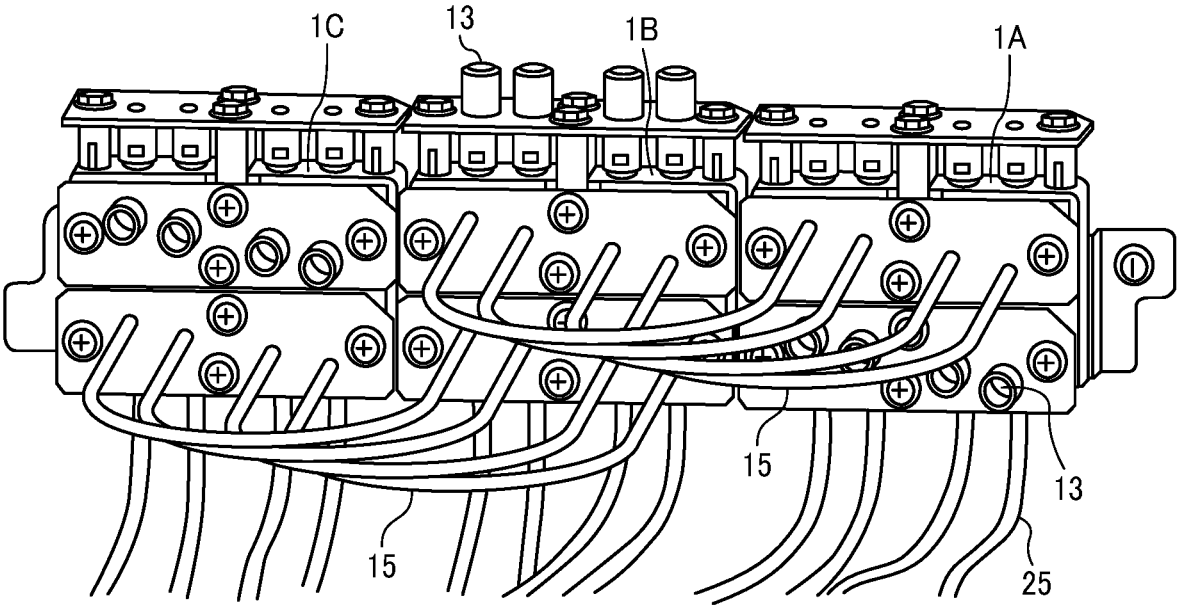
FIG. 6 is a perspective view of an example of the liquid supply system.

Next, a third embodiment of the present disclosure is described with reference to FIGS. 4 to 6. FIG. 4 is a block diagram of a liquid supply system of a liquid discharge apparatus including the supply channel member according to the present embodiment. FIG. 5 is a plan view of the liquid discharge head of the liquid discharge apparatus according to the third embodiment. Hereinafter, the "liquid discharge head" is simply referred to as "head". FIG. 6 is a perspective view of an example of the liquid supply system.

A liquid discharge apparatus 200 includes three heads 21A to 21C. Each of the heads 21A to 21C (representatively referred to as "head 21" in FIG. 5) includes four nozzle arrays Na to Nd (see FIG. 5). For example, the head 21A includes nozzle arrays N1 to N4. The head 21B includes nozzle arrays N5 to N8. The head 21C includes nozzle arrays N9 to N12. Each of the nozzle arrays Na to Nd includes nozzles n from which the liquid is discharged (see FIG. 5). Each of three heads 21A to 21C discharges a liquid of black (K) from the nozzle array Na (N4, N8 and N12), discharges a liquid of magenta (M) from the nozzle array Nb (N3, N7, an M11), discharges a liquid of cyan (C) from the nozzle array Nc (N2, N6, and N10), and discharges a liquid of yellow (Y) from the nozzle array Nd (N1, N5, and N9).

Each of the heads 21A to 21C includes four head tanks (sub tanks) Ta to Td corresponding to the nozzle arrays Na to Nd. The head tanks Ta to Td temporarily store various colors of liquids to be discharged from the nozzle arrays Na to Nd, respectively.

In FIG. 4, four nozzle arrays Na to Nd in the three heads 21A to 21C are designated as the nozzle arrays N1 to N12 from the head 21A (right side in FIG. 4) to the head 21C (left side in FIG. 4).

Further, the liquid discharge apparatus 200 includes eight main tanks C1 to C8 that are liquid storing sections for storing the liquid to be discharged from the heads 21A to 21C. Here, the main tanks C1 and C2 store the liquid of black (K), the main tanks C3 and C4 store the liquid of magenta (M), the main tanks C5 and C6 store liquid of cyan (C), and the main tanks C7 and C8 store the liquid of yellow (Y), respectively.

The liquids of desired colors described above are supplied from the eight main tanks C1 to C8 to twelve rows of the nozzle arrays N1 to N12 of three heads 21A to 21C via three supply channel members 1A to 1C according to the present embodiment.

The liquid discharge apparatus 200 includes solenoid valves V1 to V8 and channels 23. The channels 23 connects the main tanks C1 to C8 and the supply channel members 1A to 1C. Each of the solenoid valves V1 to V8 is disposed in a corresponding one of the channels 23. The solenoid valves V1 to V8 open and close the channels 23 to control the liquid flow from the main tanks C1 to C8 to the supply channel members 1A to 1C. The liquid discharge apparatus 200 further includes liquid feed pumps P1 to P12 serving as liquid feeders. Each of the liquid feed pumps P1 to P12 is disposed in a corresponding one of channels 25. The channels 25 connect the main channels Ma to Md in the supply channel members 1A to 1C and the sub tanks Ta to Td of the heads 21A to 21C, respectively.

Next, connections between the main channels Ma to Md and the branch channels Sa and Sb of the supply channel members 1A to 1C and the main tank C1 to C8 and the nozzle arrays N1 to N11 are described below.

In FIG. 4, the inlet mi and the outlet mo marked with "X" on the main channels Ma to Md are not connected to the main tanks C1 to C8 or the heads 21A to 21C. That is, the inlet mi and the outlet mo with marks "X" on the main channels Ma to Md are closed (unused). Similarly, the branch channels Sa and Sb marked with "X" are not connected to other branch channels Sa and Sb of the other supply channel member 1. That is, the branch channels Sa and Sb marked with "X" are closed (unused). Specifically, as illustrated in FIG. 6, each of unused inlets mi and outlets mo and branch channels Sa and Sb is sealed with a sealing cap 13.

As illustrated in FIGS. 4 and 6, first, the branch channels Sa of the main channels Ma to Md of the supply channel member 1A and the branch channels Sa of the main channels Ma to Md of the supply channel member 1B are mutually connected (coupled) with each other, respectively, by the connection tubes 15.

Further, the branch channels Sb of the main channels Ma to Md of the supply channel member 1B and the branch channels Sb of the main channels Ma to Md of the supply channel member 1C are mutually connected (coupled) with each other, respectively, by the connection tubes 15.

Here, the branch channels Sb of the main channels Ma to Md of the supply channel member 1A are closed (unused). Similarly, the branch channels Sa of the main channels Ma to Md of the supply channel member 1C is closed (unused).

The nozzle arrays N4, N8, and N12 formed by the nozzle arrays Na of the heads 21A, 21B, and 21C are connected to the main channels Ma of the supply channel members 1A to 1C via the sub tanks Ta and the liquid feed pumps P4, P8, and P12. Hereinafter, the above-described connection status is simply referred to as "connected".

The nozzle arrays N3, N7, and N11 formed by the nozzle arrays Nb of the heads 21A, 21B, and 21C are connected to the main channels Mb of the supply channel members 1A to 1C, respectively. The nozzle arrays N2, N6, and N10 formed by the nozzle arrays Nc of the heads 21A, 21B, and 21C are connected to the main channels Mc of the supply channel members 1A to 1C, respectively. The nozzle arrays N1, N5, and N9 formed by the nozzle arrays Nd of the heads 21A, 21B, and 21C are connected to the main channels Md of the supply channel members 1A to 1C, respectively.

Then, the main tank C1 and the main channel Ma of the supply channel member 1A are connected. Thus, the main channel Ma of the supply channel member 1A, the main channel Ma of the supply channel member 1B, and the main channel Ma of the supply channel member 1C can supply the liquid of black (K) from the main tank C1.

Further, the main tank C2 and the main channel Ma of the supply channel member 1C are connected. Thus, the main channel Ma of the supply channel member 1C, the main channel Ma of the supply channel member 1B, and the main channel Ma of the supply channel member 1A can supply the liquid of black (K) from the main tank C2.

The liquid discharge apparatus 200 can switch supply of the liquid of black (K) from one of the main tank C1 and C2 to the other of C1 and C2 using the solenoid valves V1 and V2. For example, the liquid discharge apparatus 200 starts supplying the liquid from the main tank C1 by opening the solenoid valve V1 and closing the solenoid valve V2. The liquid discharge apparatus 200 closes the solenoid valve V1 when the liquid in the main tank C1 is in an end state (empty state). Then, the liquid discharge apparatus 200 starts supplying the liquid from the main tank C2 by opening the solenoid valve V2 and closing the solenoid valve V1.

Similarly, the main tank C3 and the main channel Mb of the supply channel member 1A are connected, and the main tank C4 and the main channel Mb of the supply channel member 1C are connected. Thus, the main channel Mb of the supply channel member 1C, the main channel Mb of the supply channel member 1B, and the main channel Mb of the supply channel member 1A can supply the liquid of magenta (M) from the main tank C3 or C4.

Further, the main tank C5 and the main channel Mc of the supply channel member 1A are connected, and the main tank C6 and the main channel Mc of the supply channel member 1C are connected. Thus, the main channel Mc of the supply channel member 1C, the main channel Mc of the supply channel member 1B, and the main channel Mc of the supply channel member 1A can supply the liquid of cyan (C) from the main tank C5 or C6.

Further, the main tank C7 and the main channel Md of the supply channel member 1A are connected, and the main tank C8 and the main channel Md of the supply channel member 1C are connected. Thus, the main channel Md of the supply channel member 1C, the main channel Md of the supply channel member 1B, and the main channel Md of the supply channel member 1A can supply the liquid of yellow (Y) from the main tank C7 or C8.

Thus, the liquid discharge apparatus 200 can supply the liquids to the heads 21A to 21C by simply connecting the eight main tanks C1 to C8 and the twelve nozzle arrays N1 to N12 of the three heads 21A to 21C.

In any of the above-described embodiments, it is preferable to make the number of the supply channel members 1A to 1C to be equal to the number of the heads 21A to 21C to configure one-to-one relation. For example, in the present embodiment, the number of the heads 21A to 21C is three, and the number of supply channel member 1 is three (1A to 1C). Further, it is preferable to make the number of main channels to be equal to the number of nozzle arrays in the head to configure one-to-one relation. For example, in the present embodiment, the number of the main channels Ma to Md is four, and the number of the nozzle arrays Na to Nd is four. The relation between the supply channel members 1A to 1C and the heads 21A to 21C and the relation between the main channels Ma to Md and the nozzle arrays Na to Nd are easy to understand in the present embodiment.

Figure 7:
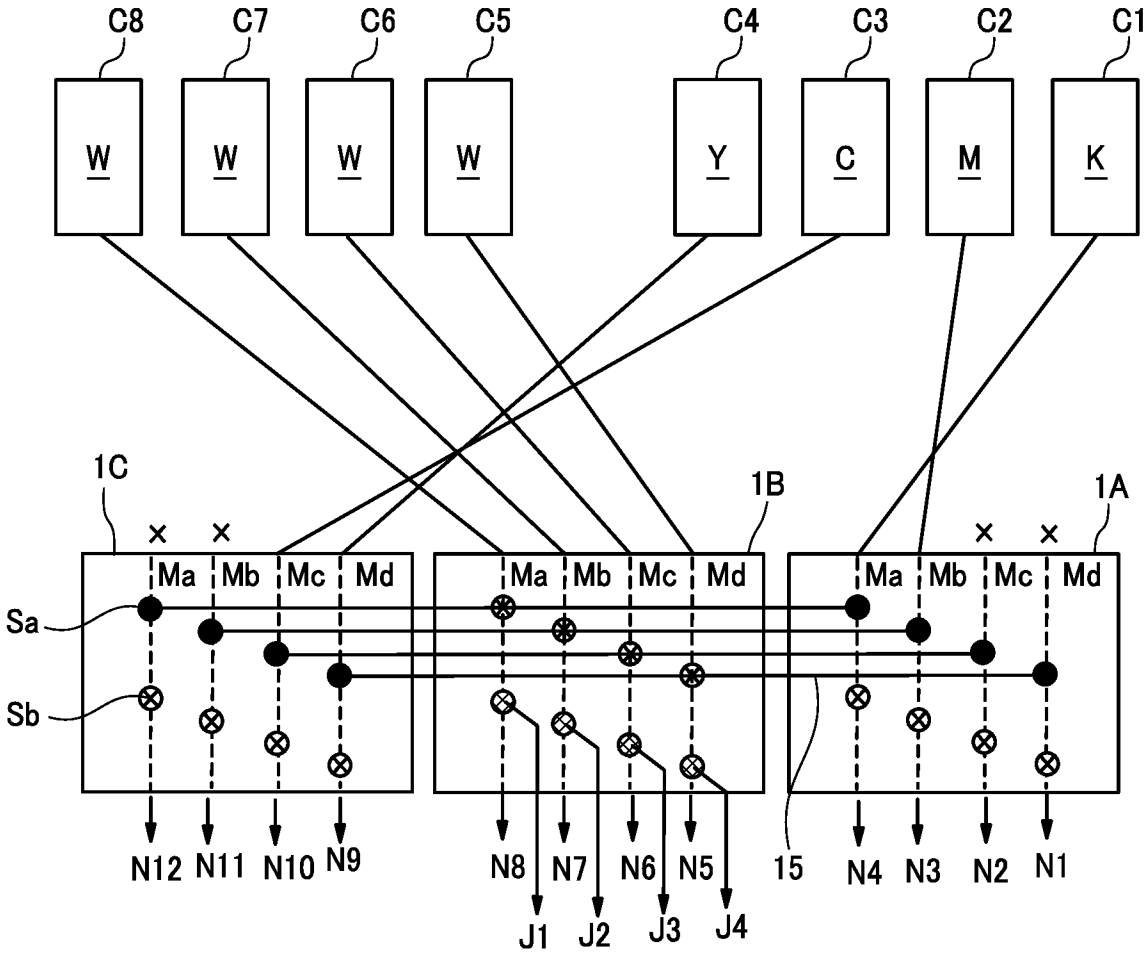
FIG. 7 is a block diagram illustrating a connection between main tanks and the supply channel members according to a first example of the third embodiment.

Next, a first example of changing the color configuration of the third embodiment is described with reference to FIG. 7. FIG. 7 is a block diagram illustrating a connection between the main tank and the supply channel member according to the first example. Configuration of the solenoid valves V1 to V8 are same as illustrated in FIG. 4 and thus abbreviated in FIG. 7.

The first example illustrated in FIG. 7 is an example using liquids of four colors of YCMK and a liquid of white (W). The main tanks C1 to C4 contain liquids of black (K), magenta (M), cyan (C), and yellow (Y), respectively. Further, all the main tanks C5 to C8 contain the liquid of white (W).

The configuration of a connection between the main channels Ma to Md of the supply channel members 1A to 1C and the nozzle arrays N1 to N12 of the heads 21A to 21C in FIG. 7 is the same as the configuration of the connection in the third embodiment illustrated in FIG. 4.

As illustrated in FIG. 7, the branch channels Sa of the main channels Ma to Md of the supply channel member 1A and the branch channels Sa of the main channels Ma to Md of the supply channel member 1C are mutually connected (coupled) with each other, respectively, by the connection tubes 15.

The branch channels Sb of the main channels Ma to Md of the supply channel member 1A, the branch channels Sa of the main channels Ma to Md of the supply channel member 1B, and the branch channels Sb of the main channels Ma to Md of the supply channel member 1C are closed (unused). Here, the branch channels Sb of the main channels Ma to Md of the supply channel member 1B are connected (coupled) to circulation channels J1 to J4.

Then, the main tank C1 and the main channel Ma of the supply channel member 1A are connected. Thus, the main channel Ma of the supply channel member 1A and the main channel Ma of the supply channel member 1C can supply the liquid of black (K) from the main tank C1.

Further, the main tank C2 and the main channel Mb of the supply channel member 1A are connected. Thus, the main channel Mb of the supply channel member 1A and the main channel Mb of the supply channel member 1C can supply the liquid of magenta (M) from the main tank C2.

Further, the main tank C3 and the main channel Mc of the supply channel member 1C are connected. Thus, the main channel Mc of the supply channel member 1C and the main channel Mc of the supply channel member 1A can supply the liquid of cyan (C) from the main tank C3.

Further, the main tank C4 and the main channel Md of the supply channel member 1C are connected. Thus, the main channel Md of the supply channel member 1C and the main channel Md of the supply channel member 1A can supply the liquid of yellow (Y) from the main tank C4.

Further, the main tanks C5 to C8 and the main channels Ma to Md of the supply channel member 1B are connected, respectively. Thus, the main channel Ma to Md of the supply channel member 1B can supply the liquid of white (W) from the main tanks C5 to C8.

Figure 8:
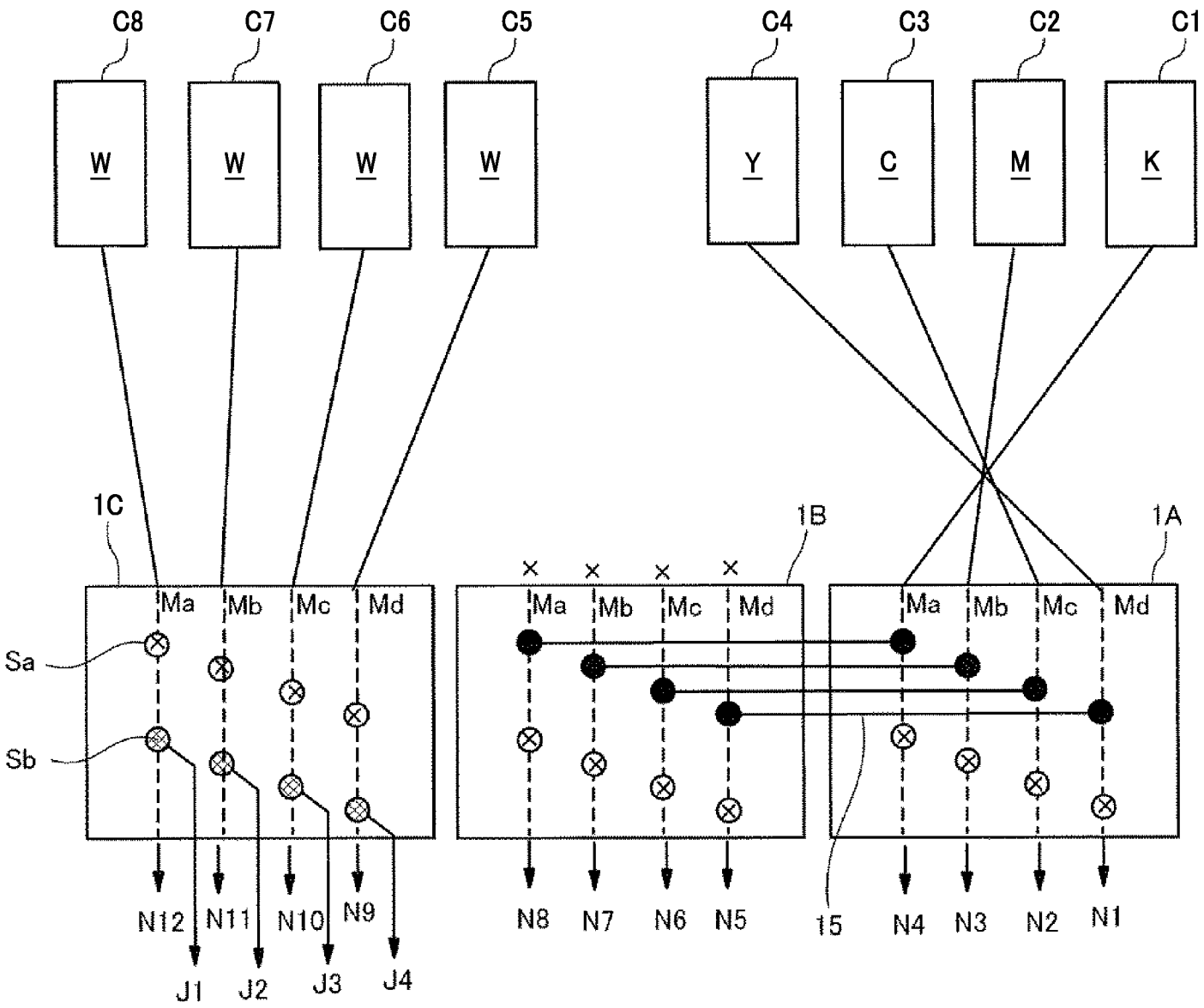
FIG. 8 is a block diagram illustrating a connection between the main tanks and the supply channel members according to a second example of the third embodiment.

Next, a second example of changing a color configuration of the above-described third embodiment is described with reference to FIG. 8. FIG. 8 is a block diagram illustrating a connection between the main tank and the supply channel member according to the second example.

The second example illustrated in FIG. 8 is an example using liquids of four colors of YCMK and a liquid of white (W). The main tanks C1 to C4 contain liquids of black (K), magenta (M), cyan (C), and yellow (Y), respectively. Further, all the main tanks C5 to C8 contains the liquid of white (W).

The configuration of a connection between the main channels Ma to Md of the supply channel members 1A to 1C and the nozzle arrays N1 to N12 of the heads 21A to 21C in FIG. 8 is the same as the configuration of the connection in the third embodiment illustrated in FIG. 4.

The branch channels Sa of the main channels Ma to Md of the supply channel member 1A and the branch channels Sa of the main channels Ma to Md of the supply channel member 1B are connected (coupled) to each other, respectively, by the connection tubes 15.

The branch channels Sb of the main channels Ma to Md of the supply channel member 1A, the branch channels Sb of the main channels Ma to Md of the supply channel member 1B, and the branch channels Sa of the main channels Ma to Md of the supply channel member 1C are closed (unused). The branch channels Sb of the main channels Ma to Md of the supply channel member 1C are connected to the circulation channels J1 to J4.

Then, the main tank C1 and the main channel Ma of the supply channel member 1A are connected. Thus, the main channel Ma of the supply channel member 1A and the main channel Ma of the supply channel member 1B can supply the liquid of black (K) from the main tank C1.

Further, the main tank C2 and the main channel Mb of the supply channel member 1A are connected. Thus, the main channel Mb of the supply channel member 1A and the main channel Mb of the supply channel member 1B can supply the liquid of magenta (M) from the main tank C2.

Further, the main tank C3 and the main channel Mc of the supply channel member 1A are connected. Thus, the main channel Mc of the supply channel member 1A and the main channel Mc of the supply channel member 1B can supply the liquid of cyan (C) from the main tank C3.

Further, the main tank C4 and the main channel Md of the supply channel member 1A are connected. Thus, the main channel Md of the supply channel member 1A and the main channel Md of the supply channel member 1B can supply the liquid of yellow (Y) from the main tank C4.

Further, the main tanks C5 to C8 and the main channels Ma to Md of the supply channel member 1C are connected, respectively. Thus, the main channels Ma to Md of the supply channel member 1C can supply the liquid of white (W) from the main tanks C5 to C8.

In this second example, the liquid of white (W) can be overcoated onto image formed by the liquids of YCMK (yellow, cyan, magenta, and black) when the heads 21A to 21C are sequentially opposed to a discharge region, in which a medium onto which the liquid is discharged is disposed, in an order from the head 21A to the head 21C.

Figure 9:
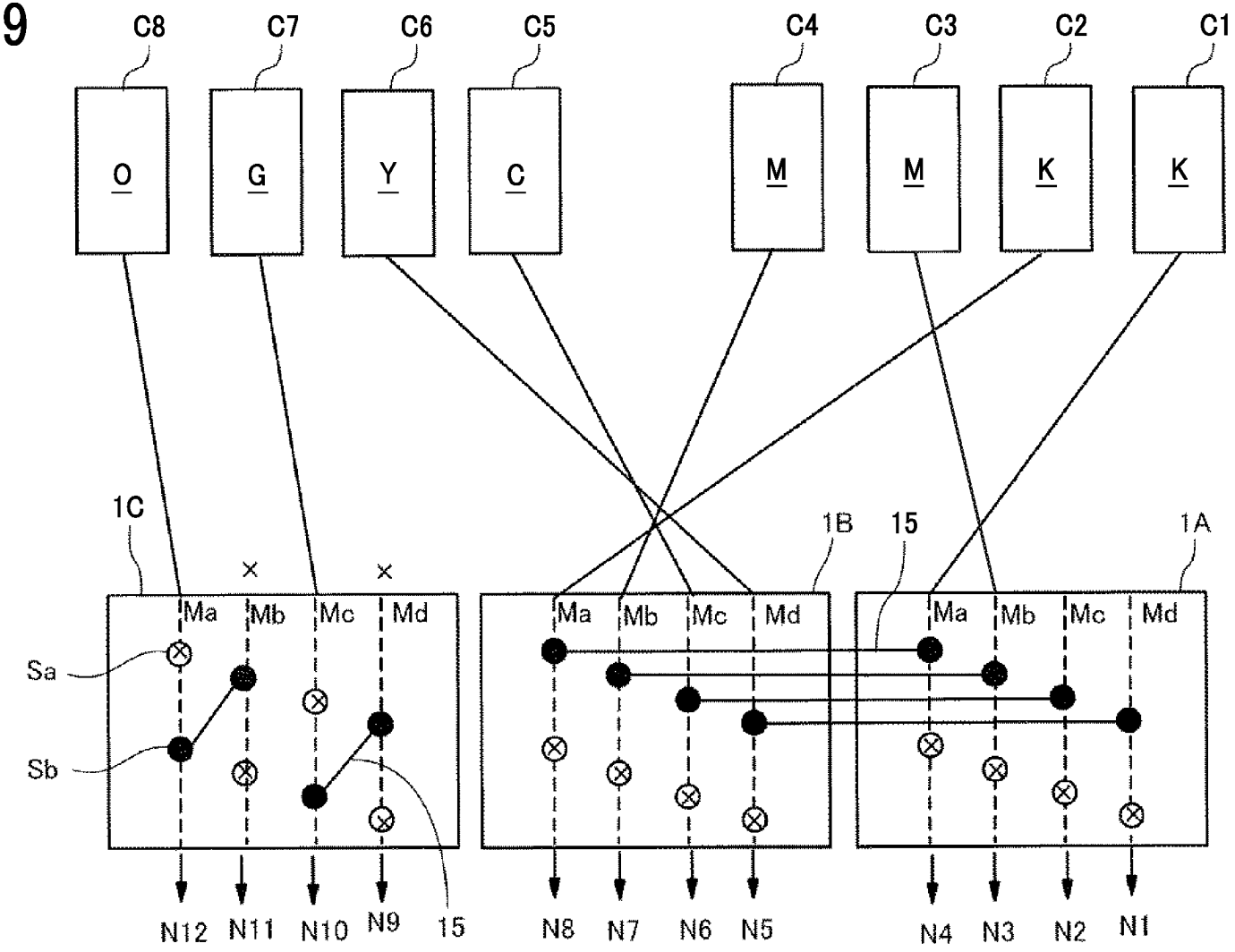
FIG. 9 is a block diagram illustrating a connection between the main tanks and the supply channel members according to a third example of the third embodiment.

Next, a third example of changing a color configuration of the above-described third embodiment is described with reference to FIG. 9. FIG. 9 is a block diagram illustrating a connection between the main tank and the supply channel member according to the third example.

The third example illustrated in FIG. 9 is an example of using six types of liquids including liquids of four colors YCMK (yellow, cyan, magenta, and black) and liquids of green (G) and orange (O). The main tanks C1 and C2 store the liquid of black (K), the main tanks C3 and C4 store the liquid of magenta (M), the main tank C5 stores liquid of cyan (C), and the main tank C6 stores the liquid of yellow (Y), respectively. The main tank C7 contains liquid of green (G), and the main tank C8 contains liquid of orange (O).

The configuration of a connection between the main channels Ma to Md of the supply channel members 1A to 1C and the nozzle arrays N1 to N12 of the heads 21A to 21C in FIG. 8 is the same as the configuration of the connection in the third embodiment illustrated in FIG. 4.

The branch channels Sa of the main channels Ma to Md of the supply channel member 1A and the branch channels Sa of the main channels Ma to Md of the supply channel member 1B are connected (coupled) to each other, respectively, by the connection tubes 15. Further, the branch channel Sb of the main channel Ma and the branch channel Sa of the main channel Mb of the supply channel member 1C are connected (coupled) with each other by the connection tube 15. Further, the branch channel Sb of the main channel Mc and the branch channel Sa of the main channel Md of the supply channel member 1C are connected (coupled) to each other by the connection tube 15.

Here, the branch channels Sb of the main channels Ma to Md of the supply channel member 1A, the branch channels Sb of the main channels Ma to Md of the supply channel member 1B, the branch channels Sa of the main channels Ma and Mc of the supply channel member 1C, and the branch channels Sb of the main channels Mb and Md of the supply channel member 1C are closed (unused).

Further, the main tank C1 and the main channel Ma of the supply channel member 1A are connected, and the main tank C2 and the main channel Ma of the supply channel member 1B are connected. Thus, the main channel Ma of the supply channel member 1A and the main channel Ma of the supply channel member 1B can supply the liquid of black (K) from at least one of the main tank C1 and C2.

Similarly, the main tank C3 and the main channel Mb of the supply channel member 1A are connected, and the main tank C4 and the main channel Mb of the supply channel member 1B are connected. Thus, the main channel Mb of the supply channel member 1A and the main channel Mb of the supply channel member 1B can supply the liquid of magenta (M) from at least one of the main tanks C3 and C4.

Further, the main tank C5 and the main channel Mc of the supply channel member 1B are connected. Thus, the main channel Mc of the supply channel member 1A and the main channel Mc of the supply channel member 1B can supply the liquid of cyan (C) from the main tank C5.

Further, the main tank C6 and the main channel Md of the supply channel member 1B are connected. Thus, the main channel Md of the supply channel member 1A and the main channel Md of the supply channel member 1B can supply the liquid of yellow (Y) from the main tank C6.

Further, the main tank C7 and the main channel Mc of the supply channel member 1C are connected. Thus, the main channels Mc and Md of the supply channel member 1C can supply the liquid of green (G) from the main tank C7.

Further, the main tank C8 and the main channel Ma of the supply channel member 1C are connected. Thus, the main channels Ma and Mb of the supply channel member 1C can supply the liquid of orange (O) from the main tank C8.

Figure 10:
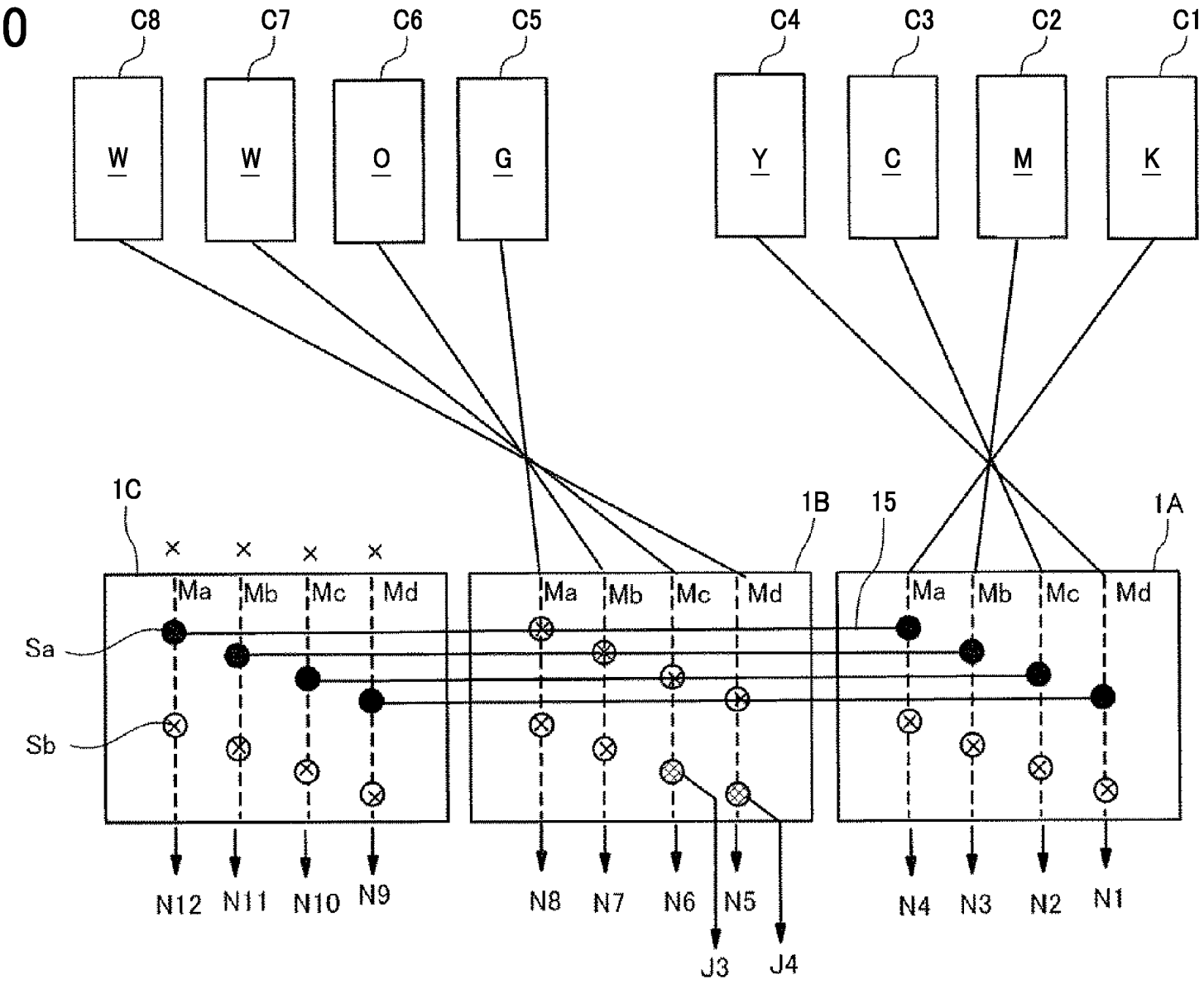
FIG. 10 is a block diagram illustrating a connection between the main tanks and the supply channel members according to a fourth example of the third embodiment.

Next, a fourth example of changing a color configuration of the above-described third embodiment is described with reference to FIG. 10. FIG. 10 is a block diagram illustrating a connection between the main tank and the supply channel member according to the fourth example.

The fourth example illustrated in FIG. 10 is an example of using seven types of liquids including liquids of four colors of yellow, cyan, magenta, and black (YCMK) and liquids of green (G), orange (O), and white (W). The main tank C1 contains the liquid of black (K), the main tank C2 contains the liquid of magenta (M), the main tank C3 contains the liquid of cyan (C), and the main tank C4 contains the liquid of yellow (Y), respectively. The main tank C5 contains the liquid of green (G), and the main tank C6 contains the liquid of orange (O) liquid, respectively. Both the main tanks C7 and C8 contain the liquid of white (W).

The configuration of a connection between the main channels Ma to Md of the supply channel members 1A to 1C and the nozzle arrays N1 to N12 of the heads 21A to 21C in FIG. 10 is the same as the configuration of the connection in the third embodiment illustrated in FIG. 4.

As illustrated in FIG. 10, the branch channels Sa of the main channels Ma to Md of the supply channel member 1A and the branch channels Sa of the main channels Ma to Md of the supply channel member 1C are mutually connected (coupled) with each other, respectively, by the connection tubes 15.

The branch channels Sb of the main channels Ma to Md of the supply channel member 1A, the branch channels Sb of the main channels Ma and Mb of the supply channel member 1B, and the branch channels Sb of the main channels Ma to Md of the supply channel member 1C are closed (unused). The branch channels Sb of the main channels Mc and Md of the supply channel member 1B are connected to the circulation channels J3 and J4.

The main tank C1 and the main channel Ma of the supply channel member 1A are connected. Thus, the main channel Ma of the supply channel member 1A and the main channel Ma of the supply channel member 1C can supply the liquid of black (K) from the main tank C1.

Further, the main tank C2 and the main channel Mb of the supply channel member 1A are connected. Thus, the main channel Mb of the supply channel member 1A and the main channel Mb of the supply channel member 1C can supply the liquid of magenta (M) from the main tank C2.

Further, the main tank C3 and the main channel Mc of the supply channel member 1A are connected. Thus, the main channel Mc of the supply channel member 1A and the main channel Mc of the supply channel member 1C can supply the liquid of cyan (C) from the main tank C3.

Further, the main tank C4 and the main channel Md of the supply channel member 1A are connected. Thus, the main channel Md of the supply channel member 1A and the main channel Md of the supply channel member 1C can supply the liquid of yellow (Y) from the main tank C4.

Further, the main tank C5 and the main channel Ma of the supply channel member 1B are connected. Thus, the main channels Ma of the supply channel member 1B can supply the liquid of green (G) from the main tank C5.

Further, the main tank C6 and the main channel Mb of the supply channel member 1B are connected. Thus, the main channels Mb of the supply channel member 1B can supply the liquid of orange (O) from the main tank C6.

Further, the main tank C7 and the main channel Mc of the supply channel member 1B are connected. Thus, the main channels Mc of the supply channel member 1B can supply the liquid of white (W) from the main tank C7.

Further, the main tank C8 and the main channel Md of the supply channel member 1B are connected. Thus, the main channels Md of the supply channel member 1B can supply the liquid of white (W) from the main tank C8.

As described above, any of the examples including the third embodiment can supply the liquids of necessary colors by using only three supply channel members 1A to 1C for the twelve rows of nozzle arrays N1 to N12 of the three heads 21A to 21C from the eight main tanks C1 to C8.

As in the first, the second, and the fourth examples, the connection tube of the circulation channel is connectable to the branch channel when the liquid of white is used. Thus, the preset embodiment can be used for various types of the liquid discharge apparatus 200.

Further, a color set (color configuration) can be changed by simply changing the piping of the connection tubes 15 of the supply channel members 1A to 1C. Thus, the present embodiment can easily change the color configuration without causing a connection error caused by complicated work of piping, and the like.

It is possible to correspond one supply channel member 1A to 1C to one head 21A to 21C by making the number of main channels Ma to Md of each of the supply channel members 1A to 1C and the number of nozzle arrays N1 to N12 of the heads 21A to 21C the same. Thus, it is not necessarily to change piping from the supply channel members 1A to 1C to the heads 21A to 21C regardless of any color variation. Therefore, it is easy to visually recognize which connection tubes 15 are connected to which nozzle arrays N1 to N12 of which heads 21A to 21C.

Further, the supply channel members 1A to 1C can be fixed to the main body 101 of the liquid discharge apparatus 200. Thus, the connecting tubes 15 do not tangles complicatedly.

Further, mounting ports of tank holders (cartridge holders) for detachably mounting the main tanks and the branching channels Sa and Sb of the supply channel members 1A to 1C are disposed perpendicular to each other. Thus, all the branch channels Sa and Sb of the main channels Ma to Md of the supply channel members 1A to 1C faces the operator to perform piping. Thus, it is easier to replace the connection tubes 15 and reduces the connection error.

Figure 11:
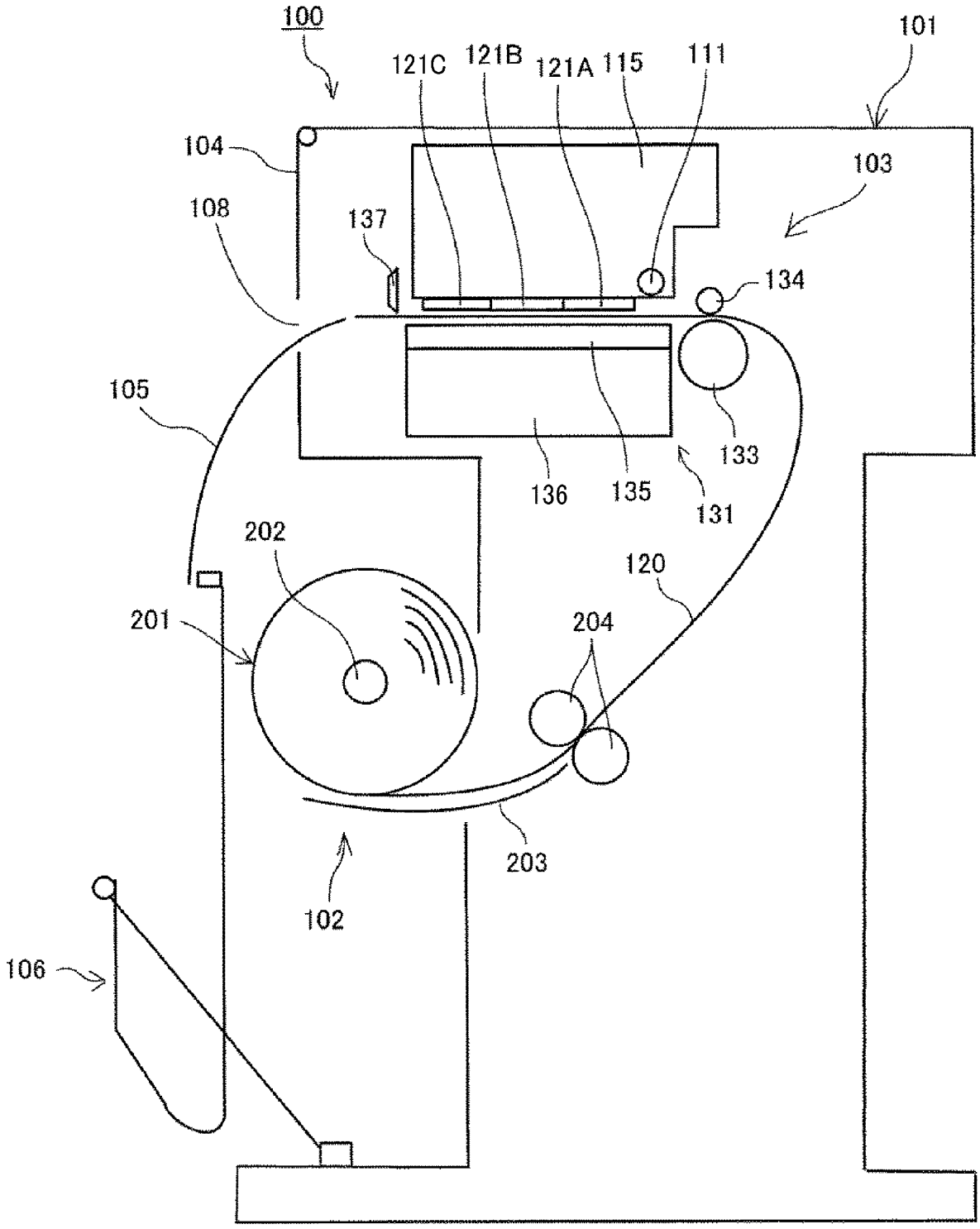
FIG. 11 is a schematic side view of a printer as the liquid discharge apparatus according to the present embodiment.
Figure 12:
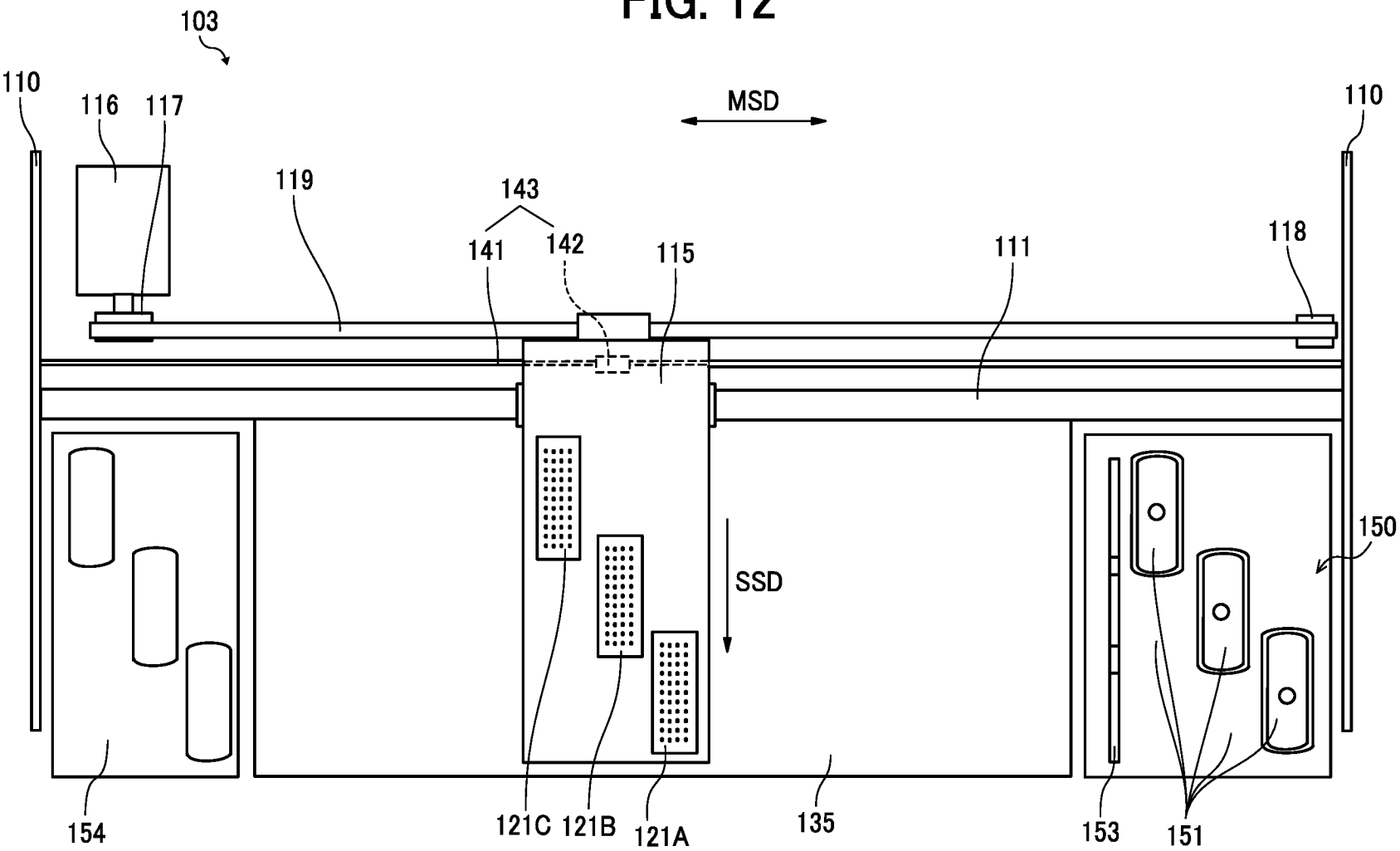
FIG. 12 is an enlarged plan view of a portion of the printer.

Next, a printer serves as the liquid discharge apparatus according to the present embodiment is described with reference to FIGS. 11 and 12. FIG. 11 is a side view of the printer according to the present embodiment. FIG. 12 is an enlarged plan view of a portion of the printer.

The printer 100 is a serial type printer and includes a main body 101 and a paper feeder 102 disposed on a lower side of the main body 101.

The printer 100 includes a printing unit 103 for printing an image on a roll paper 120, which is a roll-shaped medium fed from a paper feeder 102, in the main body 101.

Further, the printer 100 includes an ejection port 108 to eject the roll paper 120 on which the image has been printed by the printing unit 103 is ejected outside the main body 101. The ejection port 108 is disposed on a front side of the main body 101. Here, the front side of the main body 101 is the side from which the roll paper 120 printed and cut is ejected.

Further, the printer 100 includes an opening cover 104 and a lower ejection guide 105 in a vertical direction of the ejection port 108. The opening cover 104 is openable and closable and is disposed on the front side of the main body 101. The lower ejection guide 105 guides the roll paper 120 ejected from the ejection port 108. The ejected roll paper 120 may be a cut sheet cut by a cutter 137 from the roll paper 120.

The printer 100 includes a bucket 106 for accommodating the roll paper 120 ejected from the ejection port 108 and guided by the lower ejection guide 105 in a lower side of the lower ejection guide 105.

The printing unit 103 includes a guide 111 bridged between side plates 110 disposed each lateral ends of the printing unit 103 (see FIG. 12). The guide 111 holds a carriage 115 movable in a main scanning direction indicated by arrow MSD in FIG. 12.

The main scanning motor 116 reciprocally moves the carriage 115 in the main scanning direction MSD via a timing belt 119 bridged between the driving pulley 117 and the driven pulley 118. The main scanning motor 116 is disposed at one side of the printing unit 103 in the main scanning direction MSD. The driven pulley 118 is disposed at the other side of the printing unit 103.

The carriage 115 mounts a plurality of (three in FIG. 12) head units 121A to 121C. The head units 121A to 121C includes the heads 21A to 21C and the sub tanks Ta to Td forming a single unit.

The head units 121A to 121C are arranged such that the positions of the head units 121A to 121C are shifted by one head (one nozzle array) in the sub-scanning direction indicated by arrow SSD. The sub-scanning direction SSD is a direction perpendicular to the main scanning direction MSD. The colors of the liquid are assigned to each nozzle arrays N1 to N12 to be discharged (color configuration). For example, the colors may be assigned to each nozzle arrays N1 to N12 as illustrated in the first to third embodiments and the first to fourth examples. However, the present embodiment is not limited to the embodiments and examples described-above.

The printer 100 feeds the roll paper 120 from the paper feeder 102 to a printing area of the main scanning region of the carriage 115. The roll paper 120 is intermittently moved in the sub-scanning direction SSD perpendicular to the main scanning direction MSD of the carriage 115 by the conveyor 131.

The printing unit 103 includes an encoder scale 141 on which a predetermined pattern is formed. The encoder scale 141 is stretched between the side plates 110 along the main scanning direction MSD of the carriage 115. The carriage 115 includes an encoder sensor 142 made of transmissive photosensor that reads the pattern in the encoder scale 141. The encoder scale 141 and the encoder sensor 142 form a linear encoder (main scanning encoder) 143 that detects an amount of movement of the carriage 115, for example.

The conveyor 131 includes a conveyance roller 133 for conveying the roll paper 120 fed from the paper feeder 102 and a pressure roller 134 arranged to face the conveyance roller 133. The conveyor 131 includes a conveyance guide 135 in which a plurality of suction holes is formed and a suction fan 136 as suction means for sucking air through the plurality of suction holes of the conveyance guide 135.

The printer 100 includes the cutter 137 for cutting the roll paper 120, on which an image has been printed by the head units 121A to 121C, at a predetermined length. The cutter 137 is disposed on the downstream side of the conveyor 131.

Further, the printing unit 103 includes a maintenance device 150 for maintaining and recovering the head units 121A to 121C. The maintenance device 150 is disposed on one side of the conveyance guide 135 in the main scanning direction MSD of the carriage 115. The maintenance device 150 includes caps 151 to cap a nozzle face (i.e., a face on which the nozzle arrays N11 to N12 are formed) of the heads 21A to 21C of the head units 121A to 121C and a wiper 153 to wipe the nozzle face.

The printing unit 103 includes a dummy discharge receptacle 154 for receiving the liquid idly discharged from the head units 121A to 121C. The liquid idly discharged from the head units 121A to 121C is not used for printing. The dummy discharge receptacle 154 is disposed on a left side of the conveyance guide 135 that is the other side of the printing unit 103 in the main scanning direction MSD of the carriage 115 in FIG. 12.

The paper feeder 102 includes a roll body 201. The roll body 201 is formed by winding the roll paper 120 around a pipe 202 serves as a core member. The roll paper 120 is a sheet of rolled medium having a long length that is also referred to as "roll paper" as described above.

The printer 100 includes a guide 203 for guiding a lower surface of the roll paper 120 drawn out from the roll body 201 of the paper feeder 102 and a conveyance roller pair 204 for conveying the roll paper 120 upward while deforming the roll paper 120 on the main body 101 side.

The conveyance roller pair 204 is rotationally driven to convey the roll paper 120 fed from the roll body 201 while the roll paper 120 is stretched between the conveyance roller pair 204 and the roll body 201. Then, the roll paper 120 is sent to a region between the conveyance roller 133 and the pressure roller 134 of the conveyor 131 via the conveyance roller pair 204.

The printer 100 thus configured reciprocally moves the carriage 115 in the main scanning direction MSD and intermittently feeds the roll paper 120 from the paper feeder 102 by the conveyor 131.

Then, the printer 100 drives the head units 121A to 121C in accordance with the image information (printing information) to discharge the liquid to print a required image on the roll paper 120. The printer 100 cuts the roll paper 120 by a cutter 137 at a required length and ejects the cut roll paper 120 to the bucket 106.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A supply channel member, comprising:

a plate;

a plurality of main channels formed inside the plate, the plurality of main channels disposed parallel to each other along a surface of the plate in an arrangement direction of the plurality of main channels;

a plurality of branch channels formed inside the plate and branched from the plurality of main channels, respectively, wherein at least two of the plurality of branch channels are branched from each of the plurality of main channels; and a connection tube to connect one of the plurality of branch channels to another of the plurality of branch channels.

2. The supply channel member according to claim 1, wherein each of the plurality of branch channels extends in a first direction perpendicular to a second direction in which each of the plurality of main channels extends.

3. The supply channel member according to claim 2, wherein positions at which the plurality of branch channels are branched from the plurality of main channels are shifted in the second direction.

4. The supply channel member according to claim 3, wherein the positions at which the plurality of branch channels are branched are gradually decreased in the second direction from one end of the plurality of main channels to the other end of the plurality of main channels in the plate in the arrangement direction.

5. The supply channel member according to claim 1, wherein the at least two of the plurality of branch channels are disposed at a same surface of the plate.

6. The supply channel member of claim 1, wherein exactly two of the plurality of branch channels are branched from each of the plurality of main channels.

7. A liquid discharge apparatus, comprising:

a plurality of main tanks to store a liquid;

a plurality of liquid discharge heads to discharge the liquid from nozzles; and a plurality of supply channel members disposed between the plurality of main tanks and the plurality of liquid discharge heads to connect the plurality of main tanks and the plurality of liquid discharge heads, wherein a number of the plurality of supply channel members is equal to a number of the plurality of liquid discharge heads, each of the plurality of supply channel members comprising:

a plate;

a plurality of main channels formed inside the plate, the plurality of main channels disposed parallel to each other along a surface of the plate in an arrangement direction of the plurality of main channels;

a plurality of branch channels branched from the plurality of main channels, respectively; and a connection tube to connect one of the plurality of branch channels to another of the plurality of branch channels.

8. The liquid discharge apparatus according to claim 7, wherein:

each of the plurality of liquid discharge heads includes a plurality of nozzle arrays each including the nozzles; and a number of the plurality of main channels in each of the plurality of supply channel members is equal to a number of the plurality of nozzle arrays in each of the plurality of liquid discharge heads.

9. The liquid discharge apparatus according to claim 7, further comprising a plurality of valves disposed between the plurality of main tanks and the plurality of supply channel members.

10. The liquid discharge apparatus according to claim 7, further comprising a plurality of liquid feed pumps disposed between the plurality of supply channel members and the plurality of liquid discharge heads, respectively.

11. The liquid discharge apparatus of claim 7, wherein each of the main channels in a first one of the plurality of supply channel members is connected to a correspondingly located main channel in a second one of the plurality of supply channel members.

* * * * *